US007469121B2

(12) United States Patent
Lundy et al.

(10) Patent No.: US 7,469,121 B2
(45) Date of Patent: Dec. 23, 2008

(54) SOFT CONTACT PORTION FLICKER BAR ASSEMBLY AND A TONER IMAGE REPRODUCTION MACHINE INCLUDING SAME

(75) Inventors: Douglas A Lundy, Webster, NY (US); Anthony L Paolini, Rochester, NY (US); Michael Quoc Lu, Fairport, NY (US); Michael J Turan, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 299 days.

(21) Appl. No.: 11/556,851

(22) Filed: Nov. 6, 2006

(65) Prior Publication Data

US 2008/0107462 A1 May 8, 2008

(51) Int. Cl.
*G03G 21/00* (2006.01)

(52) U.S. Cl. ..... 399/353

(58) Field of Classification Search ..... 399/175, 399/287, 327, 353, 354, 355; 430/119.8, 430/119.85; 15/256.51
See application file for complete search history.

(56) References Cited

U.S. PATENT DOCUMENTS 3,978,539 A 9/1976 Yonkers
4,304,026 A 12/1981 Borostyan
4,673,284 A 6/1987 Matsumoto et al.
5,128,725 A * 7/1992 Frankel et al. ..... 399/347
5,210,582 A * 5/1993 Lundy et al. ..... 399/349
5,257,578 A 11/1993 Jackson et al.
5,416,572 A * 5/1995 Kolb et al. ..... 399/350
5,436,713 A * 7/1995 Bigelow et al. ..... 399/353
7,221,898 B2 * 5/2007 Pozniakas ..... 399/355
7,433,644 B2 * 10/2008 Lundy et al. ..... 399/349

FOREIGN PATENT DOCUMENTS

JP 57014867 A * 1/1982
JP 63137276 A * 6/1988

* cited by examiner

*Primary Examiner*—Robert Beatty
(74) *Attorney, Agent, or Firm*—Tallam I. Nguti

(57) ABSTRACT

In order to prevent built up crusts on the flicker assembly from being detrimentally dislodged due to the cleaning fibers impacting the flicker bar assembly, there is provided a soft contact portion flicker bar assembly for mounting in a machine to contact and flick the cleaning fibers moving along a fiber path. The soft contact portion flicker bar assembly includes (a) a base portion for mounting to a frame portion of the machine; (b) a body portion including a distal, first end, and an opposite, second end connected to the base portion; and (c) a tip portion connected to the first, distal end for contacting and interfering with cleaning fibers moving along the fiber path. The tip portion is made of a material having a Shore A durometer hardness of less than 85 for reducing a jarring effect of impact forces between such tip portion and the moving cleaning fibers, thereby preventing detrimental dislodging of built up crusts of particles from any part of the flicker bar assembly.

20 Claims, 3 Drawing Sheets

SOFT CONTACT PORTION FLICKER BAR ASSEMBLY AND A TONER IMAGE REPRODUCTION MACHINE INCLUDING SAME

The present disclosure is directed to flicker bars for contacting and flicking fibers of a moving member, and more particularly to such a flicker bar having a soft contact portion and a toner image reproduction machine having same.

In a typical toner image reproduction machine, for example an electrostatographic printing process machine, a sensitive photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas thereby forming an electrostatic latent image thereon corresponding to the informational areas contained within the original document.

After the electrostatic latent image is recorded on the photoconductive member, the latent image is developed by bringing a charged-developer material into contact with it. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. Thereafter, the toner particles are heated to permanently affix the powder image to the copy sheet.

The foregoing generally describes a typical black and white electrostatographic printing machine. With the advent of multicolor electrophotography, it is desirable to use an architecture that comprises a plurality of image forming stations. One example of the plural image forming station architecture utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color. In each case, residual toner particles remaining on the surface of the photoconductive member must be cleaned off before reuse. The use of cleaning fiber brushes is well known in which brush fibers move or rotate into cleaning contact with the surface of the photoconductive member and remove and carry residual toner particles from such surface. In order to maintain the desired efficiency of the cleaning apparatus, toner particles so removed by the brush fibers must in turn be removed from the brush fibers.

In general as disclosed for examples in the following patents, it is well known to remove particles or molecules from moving fibers, such as the fibers of a cleaning brush, using a flicking action created in the moving fibers by a member or device, typically called a flicker bar, that is mounted across the path of movement of, and in an interference relationship with, the moving fibers.

U.S. Pat. No. 3,978,539, issued Sep. 7, 1976 and entitled "Floor sweeper with auxiliary rotary brushes" discloses a floor sweeper having, in addition to its main brush roller, one or more auxiliary brushes for sweeping debris into the path of the main brush. Each auxiliary brush includes a brush body having an annular array of outwardly downwardly inclined brush bristles. A flexible drive ring is mounted concentric to said bristles and adjacent the roots thereof on the underside of the brush body. Both the ring and bristle tips are disposed in fixed parallel planes and the assembly is mounted on an axis which is fixed and inclined from the vertical in a manner so that the rearward brush edge will, upon forward sweeper movement, rotate transversely inwardly beneath the sweeper housing with a debris disturbing and flicking action. Downward force on the sweeper causes the drive ring to deform upwardly and to deflect the adjacent bristles in a direction away from the carpet to keep the brush-carpet friction forces generally equalized.

U.S. Pat. No. 5,257,578 issued Nov. 2, 1993 and entitled "Device for automatically cleaning blanket cylinders in an offset printing press" discloses an automatic cleaning device for cleaning blanket cylinders in a web fed offset lithographic printing press. The device includes at least one brush roller for removing foreign matter from a blanket cylinder. The device also includes pneumatic cylinders which bring the brush roller into engagable contact with the blanket cylinder and the web. A flicker roller is also provided for flicking particles and other waste debris off the brush roller. In an engaged position, the brush roller, blanket cylinder and the web form an enclosed triangular region with the flicker roller being disposed within this region. This enables the device to be self-cleaning while at the same time prevents blanket wash waste from invading inker and dampening units.

U.S. Pat. No. 4,673,284, issued Jun. 16, 1987 and entitled "Cleaning device" discloses a cleaning device for removing the residual toner particles on the insulating surface in a two color printing apparatus includes a rotatable cleaning brush having two kinds of fiber materials charged the opposite polarities, and a flicker device is also provided for flicking the brush to remove toner particles therefrom as the brush rotates.

U.S. Pat. No. 4,304,026 Dec. 8, 1981 and entitled "Cleaning apparatus for a xerographic reproduction machine" discloses an improved cleaning apparatus for cleaning a photoreceptor in a xerographic reproduction machine includes a rotatably mounted circular cleaning brush and a flicker member within a housing. A portion of the flicker member is in contact with the brush to produce a primary flicking of the brush bristles as the brush rotates out of contact with this portion. Formed in this portion of the flicker member is an aperture in the form of a slot to produce a secondary flicking of the brush bristles as the brush rotates over this portion. The flicker member is contoured so that the angle between the tangents to the flicker member and brush roll surface at the point of initial contact is very small, approximately 5 degree, but gradually increases to a maximum of approximately 45 degree before the brush rotates out of contact with the flicker member. A vacuum chamber behind the flicker member communicates with a prenip region adjacent the periphery of the brush through a vacuum aperture formed in a portion of the flicker member not in contact with the brush. This causes a major portion of the air drawn from the exterior of the housing to be drawn through the brush into the prenip region and through the slot and vacuum aperture. An air inlet is formed in the housing adjacent to where the brush rotates out of contact with the flicker member to permit air to be drawn through the housing in the general direction of rotation of the brush.

Conventionally, flicker bars or the contact portions of flicker devices or flicker assemblies have been made from hard metals such aluminum and hard plastic materials such as Teflon, nylon, ABS and polyethylene (Teflon is a trademark of E.I. duPont de Nemours & Co., Inc. of Wilmington, Del.; Nylon is a trademark of The Dow Chemical Company, and ABS is a trademark of the Komet Stahlhalter-und Werkzeugfabrik Robert Breuning GmbH company). It has however been found that the use of such conventional flicker devices having hard contact portions for contacting and flicking heat sensitive particles, such as toner particles in electrostatographic reproduction machines, causes other problems. For example, in electrostatographic reproduction machines that use a sensitive photoreceptive imaging member, electrostatic imaging devices, heat sensitive toner particles to form images, and an imaging member cleaning apparatus including a cleaning fiber brush and a conventional flicker bar, hard crusty lumps of toner that inevitably buildup on the conventional flicker bars tend to become dislodged or to break off when impacted by moving cleaning fibers making contact therewith. The dislodged crusty lumps then undesirable get caught up or trapped in any nip between the sensitive photoreceptive imaging member and any device forming a nip therewith, and there tend to prematurely scratch and damage the sensitive photoreceptive imaging member.

In accordance with the present disclosure, in order to prevent built up crusts on the flicker assembly from being detrimentally dislodged due to the cleaning fibers impacting the flicker bar assembly, there is provided a soft contact portion flicker bar assembly for mounting in a machine to contact and flick the cleaning fibers moving along a fiber path. The soft contact portion flicker bar assembly includes (a) a base portion for mounting to a frame portion of the machine; (b) a body portion including a distal, first end, and an opposite, second end connected to the base portion; and (c) a tip portion connected to the first, distal end for contacting and interfering with cleaning fibers moving along the fiber path. The tip portion is made of a material having a Shore A durometer hardness of less than 85 for reducing a jarring effect of impact forces between such tip portion and the moving cleaning fibers, thereby preventing detrimental dislodging of built up crusts of particles from any part of the flicker bar assembly.

The foregoing and other features of the instant disclosure will be apparent and easily understood from a further reading of the specification, claims and by reference to the accompanying drawings in that:

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
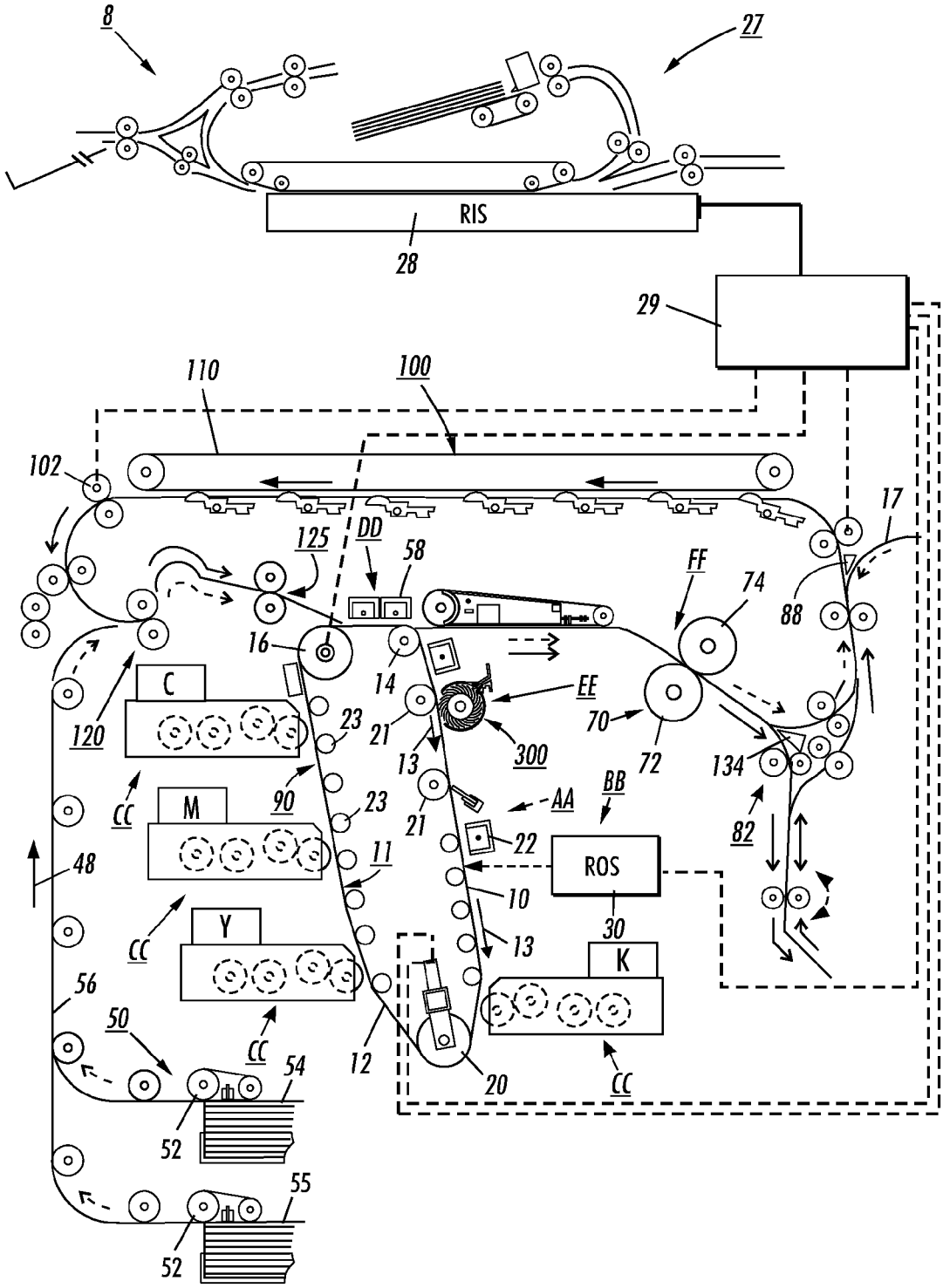
FIG. 1 is a schematic elevational view of an exemplary electrostatographic reproduction machine including the soft contact portion flicker bar assembly of the present disclosure.
Figure 2:
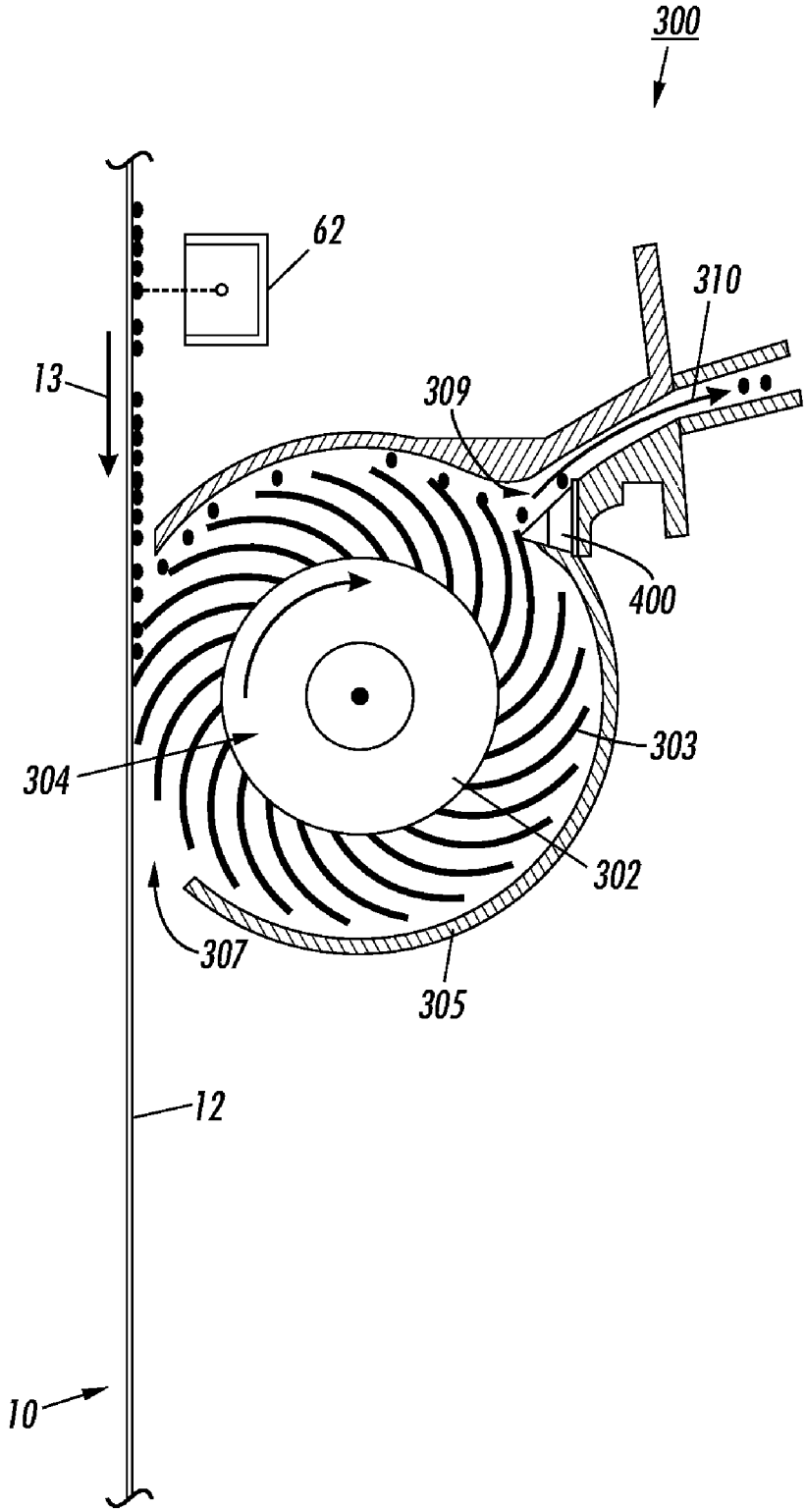
FIG. 2 is an enlarged schematic of a single brush toner particles cleaning device machine including the soft contact portion flicker bar assembly of the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes a fuser assembly indicated generally by the reference numeral 70 that permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent is transferred to a donor roll (not shown) and then to the fuser roll 72.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, the sheet when to be directed into the duplex path 100, is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where the sheet is inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, residual toner/developer and paper fiber particles that is still on and may be adhering to photoconductive surface 12 are then removed therefrom at cleaning station EE in accordance with the present disclosure. Cleaning station EE as illustrated includes a cleaning apparatus 300 for removing and taking away residual particles from the photoreceptor surface 12.

Referring now to FIGS. 1-5, the cleaning apparatus 300 includes a soft contact portion flicker bar assembly 400 for cushioning the impact of contact by moving cleaning fibers 303 of a rotatable cleaning fiber brush 304. As shown, the cleaning apparatus 300 in particular includes (a) a housing 305 having a first opening 307 and a second opening 309; (b) the rotatable cleaning fiber brush 304 mounted within the housing and having the cleaning fibers 303 for contacting the surface 12 to frictionally and/or electrostatically remove residual particles therefrom; and (c) the at least one soft contact portion flicker bar assembly 400, 402 being a second such flicker bar. The cleaning apparatus 300 may also include an air blower 306 for pulling an air stream 310 out of the housing 305. Although only one brush 304 is shown, a pair of rotatable fiber brushes as is well known will work equally well. As also shown, the cleaning apparatus 300 further includes a pre-clean charging device 62 for charging the residual particles to a desired polarity if necessary before removal.

Figure 3:
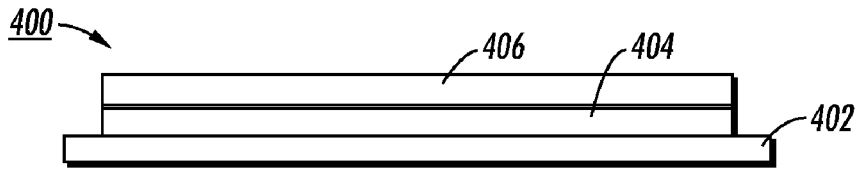
FIG. 3 is an enlarged schematic of a longitudinal side view of the soft contact portion flicker bar assembly of the present disclosure.
Figure 4:
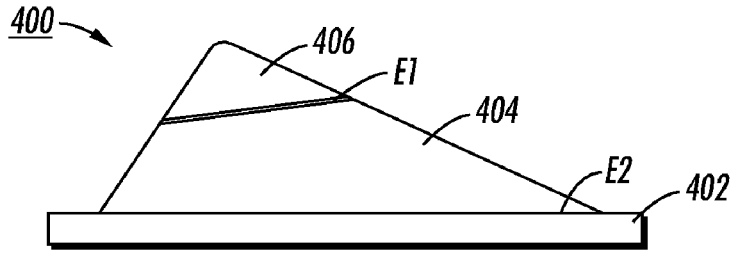
FIG. 4 is an enlarged schematic of an, end view of one embodiment of the soft contact portion flicker bar assembly of the present disclosure.
Figure 5:
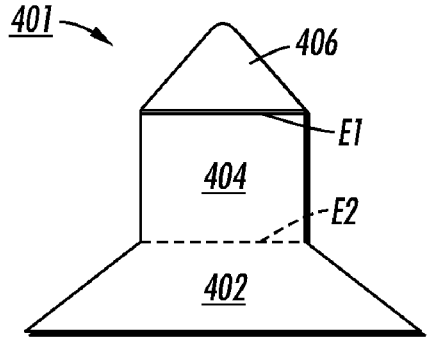
FIG. 5 is an enlarged schematic of an end view of another embodiment of the soft contact portion flicker bar assembly of the present disclosure.

As further illustrated in FIGS. 3-5, a longitudinal side view of the soft contact portion flicker bar assembly 400 is shown in FIG. 3, an end view of one embodiment 400 in FIG. 4, and an end view of another embodiment 401 in FIG. 5. As shown, the soft contact portion flicker bar assembly 400, 401 includes a base portion 402 for mounting to a frame portion of the machine; a body portion 404 including a distal, first end E1, and an opposite, second end E2 connected to the base portion 402. The soft contact portion flicker bar assembly 400, 401 also includes a tip portion 406 that is connected to the first, distal end E1 for contacting and interfering with the cleaning fibers 303 moving along the fiber path. In accordance with the present disclosure, the tip portion 406 is made of a suitable material that has a Shore A durometer hardness of less than 85 in order to reduce a jarring effect of impact forces between the tip portion 406 and the moving fibers, thereby preventing detrimental dislodging of built up crusts of particles from any part of the flicker bar assembly.

The base portion 402 may be made of a metallic material such as aluminum. The mid or body portion can be made of any functionally acceptable material, including the same material used for the tip portion. The tip portion 406 as such is made of a non-metallic material. In cleaning apparatus for toner image reproduction machines, such material of course should be selected so that it does not interact with the toner particles. As pointed out above, such materials, although conventionally being hard and thus each having a Shore A durometer hardness of greater than 95, for example a Shore D of 72 in some cases, have included Nylon, Teflon, ABS and polyethylene. To the extent that relatively softer (that is having a Shore A durometer hardness of less than 95) can be made, these materials in that form would be very suitable.

In accordance to the present disclosure, a preferred material for the tip portion is polyurethane. The polyurethane material accordingly would have a Shore A durometer hardness of less than 95, and preferably within a range of 50-85, more specifically within a range of 67-77, and in one example, a Shore A durometer hardness of 72. The body portion 404, and tip or soft contact portion 406 of the flicker bar assembly 400, 401 may be formed integrally as by molding. It is believed that the softer urethane material (50-85 Shore A) contact portion of the flicker bar assembly 400, 401, because it is relatively more compliant than conventional flicker bars, acts to cushion fiber impact, thus reducing the brush fiber impact energy.

This reduction in the impact energy advantageously prevents toner crusts that inevitably build up over time on parts of the flicker bar assembly and/or the fibers, from being jarred and becoming dislodged. As is well known, such dislodged crusts undesirably end up scratching and prematurely damaging machine parts, particularly the photoreceptor. The reduction in impact energy also is believed to extend the flicker bar wear life. Furthermore, it is believed that the relatively lower impact energy also reduces the heat generated on the impacted surfaces and thereby reduces heat caused buildup of toner particles on the flicker bar surfaces for example. As such, the soft contact portion flicker bar assembly of the present disclosure will find suitable application in any machine that handles heat sensitive material, such as powder toners, and that uses a brush cleaner apparatus to clean any of the material handling surfaces therein.

Thus, in order to prevent built up crusts on the flicker assembly from being detrimentally dislodged due to the cleaning fibers impacting the flicker bar assembly, there is provided a soft contact portion flicker bar assembly for mounting in a machine to contact and flick the cleaning fibers moving along a fiber path. The soft contact portion flicker bar assembly includes (a) a base portion for mounting to a frame portion of the machine; (b) a body portion including a distal, first end, and an opposite, second end connected to the base portion; and (c) a tip portion connected to the first, distal end for contacting and interfering with cleaning fibers moving along the fiber path. The tip portion is made of a material having a Shore A durometer hardness of less than 85 for reducing a jarring effect of impact forces between such tip portion and the moving cleaning fibers, thereby preventing detrimental dislodging of built up crusts of particles from any part of the flicker bar assembly.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A soft contact portion flicker bar assembly for mounting in a machine to contact and flick fibers moving along a fiber path; the flicker bar assembly comprising:

(a) a base portion for mounting to a frame portion of the machine;

(b) a body portion including a distal, first end, and an opposite, second end connected to said base portion; and (c) a tip portion connected to said first, distal end for contacting and interfering with fibers moving along said fiber path, said tip portion being made of a material having a Shore A durometer hardness of less than 85 for reducing a jarring effect of impact forces between said tip portion and the moving fibers, thereby preventing detrimental dislodging of built up crusts of particles from any part of the flicker bar assembly.

2. The soft contact portion flicker bar assembly of claim 1, wherein said base portion is made of a metallic material.

3. The soft contact portion flicker bar assembly of claim 1, wherein said tip portion is made of a non-metallic material.

4. The soft contact portion flicker bar assembly of claim 1, wherein said tip portion is made of a polyurethane material.

5. The soft contact portion flicker bar assembly of claim 4, wherein said polyurethane material has a Shore A durometer hardness within a range of 50-85.

6. The soft contact portion flicker bar assembly of claim 5, wherein said polyurethane material has a Shore A durometer hardness within a range of 67-77.

7. The soft contact portion flicker bar assembly of claim 5, wherein said polyurethane material has a Shore A durometer hardness of 72.

8. A cleaning apparatus for use in a toner image reproduction for removing residual toner particles from an imaging surface, the cleaning apparatus comprising;

(a) a housing including a first opening for positioning against the imaging surface, and a second opening for exhausting air and toner particles out of said housing;

(b) a rotatable cylindrical brush mounted within said housing and having cleaning fibers for contacting said imaging surface to remove residual toner particles therefrom, said cleaning fibers having a fiber path of movement between said first opening and said second opening; and (c) a soft contact portion flicker bar assembly mounted within said housing across said fiber path of movement to contact and flick said cleaning fibers, the flicker bar assembly including:

(i) a base portion for mounting to said housing;

(ii) a body portion including a distal, first end and an opposite, second end connected to said base portion; and (iii) a tip portion connected to said first, distal end for contacting and interfering with said cleaning fibers moving along said fiber path of movement, said tip portion being made of a soft material having a Shore A durometer hardness of less than 85 for reducing impact forces between said tip portion and the moving fibers, and hence preventing relatively high impact force detrimental dislodging of built up crusts of particles from any part of the cleaning apparatus.

9. The cleaning apparatus of claim 8, wherein said base portion is made of a metallic material.

10. The cleaning apparatus of claim 8, wherein said tip portion is made of a non-metallic material.

11. The cleaning apparatus of claim 8, wherein said tip portion is made of a polyurethane material.

12. The cleaning apparatus of claim 11, wherein said polyurethane material has a Shore A durometer hardness within a range of 50-85.

13. The cleaning apparatus of claim 12, wherein said polyurethane material has a Shore A durometer hardness within a range of 67-77.

14. The cleaning apparatus of claim 12, wherein said polyurethane material has a Shore A durometer hardness of 72.

15. A toner image reproduction machine comprising;

(a) a movable toner image bearing member having an image bearing surface and a path of movement;

(b) toner image forming devices mounted along said path of movement for forming a toner image on said image bearing surface;

(c) transfer means for transferring said toner image from said image bearing surface onto a substrate; and (d) a fiber brush cleaning apparatus, including a flicker bar assembly, for cleaning and removing residual toner particles from said image bearing surface; said flicker bar assembly having;

(i) a base portion for mounting to said housing;

(ii) a body portion including a distal, first end and an opposite, second end connected to said base portion; and (iii) a tip portion connected to said first, distal end for contacting and interfering with said cleaning fibers moving along said fiber path of movement, said tip portion being made of a soft material having a Shore A durometer hardness of less than 85 for reducing impact forces between said tip portion and the moving fibers, and hence preventing relatively high impact force detrimental dislodging of built up crusts of particles from any part of the cleaning apparatus.

16. The toner image reproduction machine of claim 15, wherein said tip portion is made of a non-metallic material.

17. The toner image reproduction machine of claim 15, wherein said tip portion is made of a polyurethane material.

18. The toner image reproduction machine of claim 17, wherein said polyurethane material has a Shore A durometer hardness within a range of 50-85.

19. The toner image reproduction machine of claim 18, wherein said polyurethane material has a Shore A durometer hardness within a range of 67-77.

20. The toner image reproduction machine of claim 18, wherein said polyurethane material has a Shore A durometer hardness of 72.

* * * * *